US009902408B2

(12) United States Patent
Chen et al.

(10) Patent No.: US 9,902,408 B2
(45) Date of Patent: Feb. 27, 2018

(54) VERTICAL SPRING SUPPORT DEVICE FOR COUPLER

(71) Applicant: QINGDAO SRI TECHNOLOGY CO., LTD., Qingdao (CN)

(72) Inventors: Kai Chen, Qingdao (CN); Hui Liu, Qingdao (CN); Hai Zhao, Qingdao (CN)

(73) Assignee: QINGDAO SRI TECHNOLOGY CO., LTD., Shandong (CN)

( * ) Notice: Subject to any disclaimer, the term of this patent is extended or adjusted under 35 U.S.C. 154(b) by 0 days.

(21) Appl. No.: 15/528,749

(22) PCT Filed: May 25, 2016

(86) PCT No.: PCT/CN2016/083263
§ 371 (c)(1),
(2) Date: May 22, 2017

(87) PCT Pub. No.: WO2017/054476
PCT Pub. Date: Apr. 6, 2017

(65) Prior Publication Data

US 2017/0334468 A1 Nov. 23, 2017

(30) Foreign Application Priority Data

Sep. 28, 2015 (CN) ..... 2015 1 0629599

(51) Int. Cl.
*B61G 9/04* (2006.01)
*B61G 9/22* (2006.01)

(52) U.S. Cl.
CPC *B61G 9/04* (2013.01); *B61G 9/22* (2013.01)

(58) Field of Classification Search
CPC ..... B61G 9/04; B61G 9/22; B61G 9/24
See application file for complete search history.

(56) References Cited

U.S. PATENT DOCUMENTS 4,345,689 A * 8/1982 Chierici ..... B29C 37/0085 213/60
4,376,488 A * 3/1983 Altherr ..... B61G 9/22 213/61

(Continued)

FOREIGN PATENT DOCUMENTS

CA 2 202 568 C 10/1998
CN 1976840 A 6/2007

(Continued)

OTHER PUBLICATIONS

International Search Report of corresponding International PCT Application No. PCT/CN2016/083263, dated Aug. 31, 2016.

(Continued)

*Primary Examiner* — Zachary L Kuhfuss
(74) *Attorney, Agent, or Firm* — J.C. Patents

(57) ABSTRACT

A vertical spring support device for a coupler, comprises a support platform, a bracket, a support rod, a support spring, a wear sleeve and a locknut; the support spring is sheathed on the support rod, and an upper end of the support spring is resisted against a lower surface of the support platform while a lower end of the support spring is resisted against an upper end face of the bracket; an upper end of the support rod is fixedly connected to the lower surface of the support platform, while a bottom end of the support rod passes through the bracket and is then in threaded connection to the locknut via the wear sleeve; the support platform comprises a vertical support platform plate and a horizontal support platform plate, and a lower surface of the horizontal support platform plate is fixedly connected to the upper end of the support rod; and, the vertical support platform plate is vertically fixed on one side of the horizontal support platform plate close to the buffer shell.

13 Claims, 7 Drawing Sheets

(56) References Cited

U.S. PATENT DOCUMENTS

| | | | | |
|---|---|---|---|---|
| 5,351,844 | A | 10/1994 | Carlstedt | 213/44 |
| 6,357,612 | B1 | 3/2002 | Monaco et al. | 213/43 |
| 8,960,464 | B2 * | 2/2015 | Peckham | B61G 9/24 213/9 |
| 2012/0255926 | A1 | 10/2012 | Peckham | 213/40 R |
| 2015/0114921 | A1 * | 4/2015 | Chen | B61G 9/22 213/155 |

FOREIGN PATENT DOCUMENTS

| | | | | |
|---|---|---|---|---|
| CN | 201376574 | Y | 1/2010 | |
| CN | 201376575 | Y | 1/2010 | |
| CN | 201890238 | U | 7/2011 | |
| CN | 102424056 | A | 4/2012 | |
| CN | 102632906 | A | 8/2012 | |
| CN | 103476659 | A | 12/2013 | |
| CN | 105083318 | A | 11/2015 | |
| EP | 1 955 918 | A1 | 8/2008 | |
| EP | 1955918 | * | 8/2008 | B61G 7/08 |
| EP | 2 617 622 | A1 | 7/2013 | |
| EP | 2617622 | A1 * | 7/2013 | B61G 7/12 |
| GB | 1 353 227 | | 5/1974 | |

OTHER PUBLICATIONS

Chinese Search Report of corresponding Chinese application No. 201510629599.X, dated Jun. 3, 2016.

The Supplementary European Search Report of corresponding European application No. 16 85 0101, dated Sep. 5, 2017.

* cited by examiner

VERTICAL SPRING SUPPORT DEVICE FOR COUPLER

CROSS-REFERENCE TO RELATED APPLICATION

This application is a national phase application of international application No. PCT/CN2016/083263 filed on May 25, 2016, which in turn claims the priority benefits of Chinese application No. 201510629599.X filed on Sep. 28, 2015. The contents of these prior applications are hereby incorporated by reference in its entirety.

TECHNICAL FIELD

The present application relates to the technical field of railway vehicles, and in particular to a vertical spring support device for a coupler.

BACKGROUND OF THE PRESENT INVENTION

As a basic component for a railway vehicle, a coupler buffer device serves to quickly connect and disconnect railway vehicles, deliver the train traction, ensure the running safety of the train, improve the comfort performance of the vehicles and the like.

To conveniently coupling vehicles to be reconnected, the horizontal height of the coupler needs to be maintained within a certain range in order to couple two vehicles to be reconnected successfully. To ensure the horizontal height of the coupler and prevent the coupler from hanging down to influence the coupling, an automatic coupler is generally equipped with a vertical support device.

The vertical support device is generally located below a coupler buffer shell, and an uplifting force is applied to the buffer shell by configuring a rubber block, a spring box or other elastic elements so as to ensure the horizontal height of the coupler and prevent the coupler from hanging down. A vertical support device, in form of a rubber block, is generally fixed below the coupler via a bracket, and the amount of compression of the rubber block between the coupler buffer shell and the bracket is adjusted by a bolt and a locknut so that the uplifting force is changed and the adjustment to the horizontal height of the coupler is realized. Such a vertical support device has the disadvantage of a large occupancy space below the vehicle, and also has a short service life due to the creep and aging of the rubber block. A general vertical spring support device also occupies a larger space below the vehicle, and generally has no function of adjusting the support force. Although the general vertical spring support device provides a certain support function, the height of the coupler cannot be adjusted when the coupler is hung down.

The prior art (CN201890238U) discloses a support unit for a vertical support device of a tight-lock coupler and specifically discloses the following features: a base is fixedly connected to a bracket on a mounting base via a fastening bolt; a coupler buffer is pressed on a spring box; and, the coupler buffer as a whole can rotate at a certain angle in a vertical direction due to an external force, and can return to the original position due to its own structure after the external force is removed. When the vertical angle of the whole coupler buffer is to be adjusted, an adjusting bolt is detached, a round nut is rotated leftward or rightward by a certain angle, and then the adjusting bolt is mounted and fastened again after the angle of the whole coupler buffer meets the requirements. That is, the afore-mentioned coupler buffer can realize the adjustment to the vertical angle of the whole buffer. However, this adjustment is realized by the distance from the round nut to the base. That is, it is unable to adjust the vertical force, and the vertical adjustment angle and distance are limited by the height of the coupler. Meanwhile, when the above-described vertical support structure or a conventional vertical support structure is used, a centring bracket for clamping the coupler buffer shell is further provided in addition to the vertical support structure. In this way, it is ensured that the vertical support structure sways with the coupler.

SUMMARY OF THE PRESENT INVENTION

An objective of the present application is to provide a vertical spring support device for a coupler, which plays a role of clamping while supplying a vertical support force, saves the space below the vehicle, and realizes real-time adjustment to the height of the coupler.

The present application employs the following technical solutions. A vertical spring support device for a coupler, is mounted on two sides of a buffer shell at a rear end of a coupler, and support device mounting components are provided at opposite positions on two sides of the buffer shell; the vertical spring support device for a coupler comprises a support platform, a bracket, a support rod, a support spring, a wear sleeve and a locknut; the support spring is sheathed on the support rod, and an upper end of the support spring is resisted against a lower surface of the support platform while a lower end of the support spring is resisted against an upper end face of the bracket; an upper end of the support rod is fixedly connected to the lower surface of the support platform, while a bottom end of the support rod passes through the bracket and is then in threaded connection to the locknut via the wear sleeve; the support platform comprises a vertical support platform plate and a horizontal support platform plate, and a lower surface of the horizontal support platform plate is fixedly connected to the upper end of the support rod; and, the vertical support platform plate is vertically fixed on one side of the horizontal support platform plate close to the buffer shell and embedded into a hollow structure of the support device mounting component from a bottom side, the vertical support platform plate is appressed to a surface of the buffer shell, and a wear plate is provided at a contact position between the vertical support platform plate and the buffer shell.

Preferably, the support device mounting components are annular wing plates which are mounted horizontally and are of a half-surrounded structure; a middle portion of each of the wing plates is of a hollow structure for mounting the support platform; and the support platform and the coupler buffer shell are clamped by the wing plates.

Preferably, the lower surface of the horizontal support platform plate is resisted against the upper end of the support spring, while an upper surface of the horizontal support platform plate is resisted against a lower surface of one wing plate.

Preferably, the support platform, the support rod, the support spring, the wear sleeve and the locknut are assembled together in accordance with the above connection relationship to form an assembled member I; there are two sets of assembled member I in total; and, two support rods belonging to the two sets of assembled member I pass through the bracket separately, and the two sets of assembled member I are separately arranged at two ends of the bracket.

Preferably, the bracket comprises a bracket I, a middle bracket and a bracket II; the bracket I and the bracket II are of a same structure and collectively called sub-brackets, and are symmetrical about the middle bracket; one end of each of the sub-brackets is connected to the middle bracket, while one another end of each of the sub-brackets is a cantilevered end at which a bracket guide hole is formed and one set of assembled member I is arranged through the bracket guide hole; the support rod in one set of assembled member I passes through the bracket guide hole and is then connected to the locknut; and, there are two sets of assembled member I, which are symmetrical about the middle bracket.

Preferably, a mounting hole for mounting the vertical spring support device for a coupler onto a buffer is formed on the middle bracket. Specifically, the bracket is mounted on a coupler yoke pin of the buffer through the mounting hole.

Preferably, an output force of the support spring is greater than a force required for leveling the coupler.

Preferably, there are two reinforcing ribs in total provided between the vertical support platform plate and the horizontal support platform plate, and the two reinforcing ribs are vertically fixed at two ends of the horizontal support platform plate; each of the reinforcing ribs is of a right trapezoid structure, and a right-angle side of the right trapezoid structure fixed to the vertical support platform plate and a base of the right trapezoid structure fixed to the horizontal support platform plate.

In the afore-mentioned application, the vertical spring support device for a coupler can serve as an independent component of the buffer, which is connected to other components of the buffer, such as the buffer shell, the support device mounting components arranged on the buffer shell, and the coupler yoke pin.

A vertical spring support device for a coupler, comprises a support platform, a bracket, a support rod, a support spring and a locknut; the support spring is sheathed on the support rod, and an upper end of the support spring is resisted against a lower surface of the support platform while a lower end of the support spring is resisted against an upper end face of the bracket; an upper end of the support rod is fixedly connected to the lower surface of the support platform, while a bottom end of the support rod passes through the bracket and is then in threaded connected to the locknut; the support platform comprises a vertical support platform plate and a horizontal support platform plate, a lower surface of the horizontal support platform plate is fixedly connected to the upper end of the support rod, and the vertical support platform plate is vertically fixed on one side of the horizontal support platform plate; the support platform, the support rod, the support spring and the locknut are assembled together in accordance with the above connection relationship to form an assembled member II, and there are two sets of assembled member II; two support rods belonging to the two sets of assembled member II separately pass through the bracket and are separately arranged at two ends of the bracket; and, two vertical support platform plates belonging to the two sets of assembled member II are provided on inner sides of two horizontal support platform plates, respectively.

Preferably, the vertical spring support device for a coupler further comprises a wear sleeve, and the bottom end of the support rod passes through the bracket and is then in threaded connection to the locknut via the wear sleeve. The arrangement of the wear sleeve can effectively reduce the wear between the bracket and the locknut. The wear sleeve and the assembled member II are assembled together in accordance with the above relationship to form an assembled member I, and there are two sets of assembled member I.

Preferably, a wear plate for reducing the friction between the vertical support platform plate and the buffer shell is provided on an outer side of the vertical support platform plate.

Preferably, the bracket comprises a bracket I, a middle bracket and a bracket II; the bracket I and the bracket II are of a same structure and collectively called sub-brackets, and are symmetrical about the middle bracket; one end of each of the sub-brackets is connected to the middle bracket, while one another end of each of the sub-brackets is a cantilevered end at which a bracket guide hole is formed and one set of assembled member I or one set of assembled member II is arranged through the bracket guide hole; the support rod in one set of assembled member I or one set of assembled member II passes through the bracket guide hole and is then connected to the locknut; and, there are two sets of assembled member I or assembled member II, which are symmetrical about the middle bracket.

Preferably, a mounting hole for mounting the vertical spring support device for a coupler onto a buffer shell when in use is formed on the middle bracket. Specifically, the bracket is mounted on a bottom end of a coupler yoke pin through the mounting hole.

Preferably, an output force of the support spring is greater than a force required for leveling the coupler.

Preferably, reinforcing ribs are provided between the vertical support platform plate and the horizontal support platform plate.

When in use, the vertical spring support device for a coupler can serve as a part of the buffer, which is connected to other components of the buffer. In this case, the buffer can be regarded as a buffer having a vertical spring support device for a coupler, and comprises a buffer shell, two support device mounting components, a coupler yoke pin and the vertical spring support device for a coupler.

As described above, the vertical spring support device for a coupler, comprises a support platform, a bracket, a support rod, a support spring and a locknut; the support spring is sheathed on the support rod, and an upper end of the support spring is resisted against a lower surface of the support platform while a lower end of the support spring is resisted against an upper end face of the bracket; an upper end of the support rod is fixedly connected to the lower surface of the support platform, while a bottom end of the support rod passes through the bracket and is then in threaded connected to the locknut; the support platform comprises a vertical support platform plate and a horizontal support platform plate, a lower surface of the horizontal support platform plate is fixedly connected to the upper end of the support rod, and the vertical support platform plate is vertically fixed on one side of the horizontal support platform plate; the support platform, the support rod, the support spring and the locknut are assembled together in accordance with the above connection relationship to form an assembled member II, and there are two sets of assembled member II; two support rods belonging to the two sets of assembled member II separately pass through the bracket and are separately arranged at two ends of the bracket; and, two vertical support platform plates belonging to the two sets of assembled member II are provided on inner sides of two horizontal support platform plates, respectively.

Two support device mounting components are arranged on two sides of a buffer shell, respectively, and each of the support device mounting components has a hollow structure.

The vertical support platform plate is embedded into the hollow structure of the support device mounting component from a bottom side, and the vertical support platform plate is fitted to a surface of the buffer shell. The bracket is connected to a bottom end of a coupler yoke pin so that the whole vertical spring support device for a coupler is fixed onto the buffer.

Preferably, the vertical spring support device for a coupler further comprises a wear sleeve, and the bottom end of the support rod passes through the bracket and is then in threaded connection to the locknut via the wear sleeve. The arrangement of the wear sleeve can effectively reduce the wear between the bracket and the locknut. The wear sleeve and the assembled member II are assembled together in accordance with the above relationship to form an assembled member I, and there are two sets of assembled member I.

Preferably, wear plate is provided on an outer side of the vertical support platform plate or on an outer side of the buffer shell. The wear plate is located at a contact position between the vertical support platform plate and the buffer shell for reducing the friction between the vertical support platform plate and the buffer shell.

Preferably, the bracket comprises a bracket I, a middle bracket and a bracket II; the bracket I and the bracket II are of a same structure and collectively called sub-brackets, and are symmetrical about the middle bracket; one end of each of the sub-brackets is connected to the middle bracket, while one another end of each of the sub-brackets is a cantilevered end at which a bracket guide hole is formed and one set of assembled member I or one set of assembled member II is arranged through the bracket guide hole; the support rod in one set of assembled member I or one set of assembled members II passes through the bracket guide hole and is then connected to the locknut; and, there are two sets of assembled member I or assembled member II, which are symmetrical about the middle bracket.

Preferably, a mounting hole for mounting the vertical spring support device for a coupler onto a buffer shell is formed on the middle bracket. Specifically, the bracket is mounted on a bottom end of a coupler yoke pin through the mounting hole.

Preferably, an output force of the support spring is greater than a force required for leveling the coupler.

Preferably, reinforcing ribs are provided between the vertical support platform plate and the horizontal support platform plate.

Compared with the prior art, the present application has the following beneficial effects:

(1) the support device mounting components and the support platform in the present application serve as a clamping mechanism while delivering the vertical support force, that is, the support platform and the support device mounting components dually ensure that the bracket and the support spring sway with the coupler;

the support platform has the following functions: the horizontal support platform plates provide a vertical support force via the support device mounting components (particularly the wing plates), and the vertical support platform plates arranged on two sides of the coupler clamp the coupler buffer to make the coupler buffer rotate with the coupler, so that the vertical support structure and the clamping structure are combined together;

the support device mounting components have the following functions: the support device mounting components bear the vertical support force and meanwhile surround the vertical support platform plates on the two sides of the coupler buffer to ensure that the vertical support mechanism rotates with the coupler, so that the secondary clamping effect is realized;

(2) the support springs are arranged on two sides of the buffer shell, a position for applying a vertical force is moved upward from the bottom of the coupler to the support device mounting components on two sides of the coupler buffer, and thus there is not such a large space occupancy below the vehicle, so that it is advantageous for the structural layout and design of the space in the vehicle body; and, particularly for a low-floor vehicle, the adjustment to the height of the support device will not be influenced when the coupler is hung down; and (3) the amount of compression of the support spring is controlled by the support rod and the locknut, and the height of the support spring is effectively controlled by the support platform, the support rod, the bracket and the locknut, so that the horizontal position of the coupler can be adjusted in real time under the premise that the vertical force of the support springs is enough to support the coupler.

BRIEF DESCRIPTION OF THE DRAWINGS

FIG. 7 is a structural diagram of a support spring, in which:

1: buffer shell;
2: wing plate;
3: support platform;
4: bracket;
5: support rod;
6: support spring;
7: wear sleeve;
8: locknut;
9: bracket central axis;
10: coupler yoke pin;
41: bracket I;
42: middle bracket
43: bracket II;
44: bracket guide hole;
45: mounting hole;
31: vertical support platform plate;
32: horizontal support, platform plate; and
33: reinforcing rib.

DETAILED DESCRIPTION OF THE PRESENT INVENTION

To make the objectives, technical solutions and advantages of the present application clearer, the technical solutions in embodiments of the present application will be clearly and completely described below with reference to the accompanying drawings in the embodiments of the present application.

Embodiment 1

Figure 1:
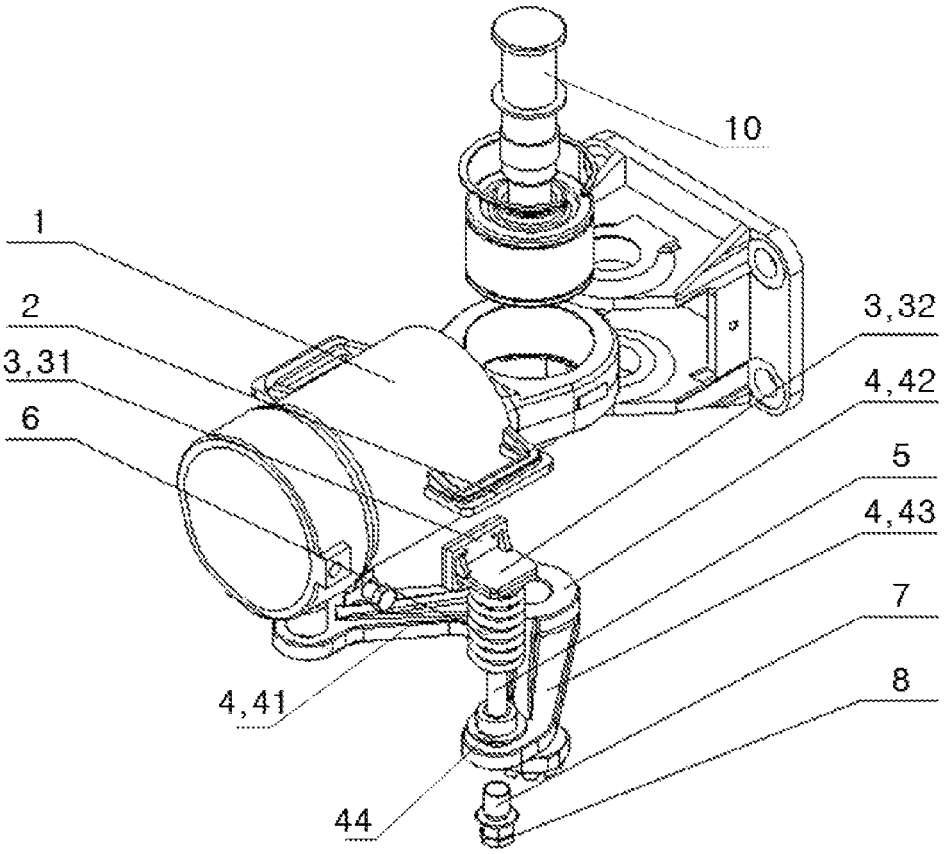
FIG. 1 is an exploded view of a buffer and a vertical spring support device for a coupler.
Figure 2:
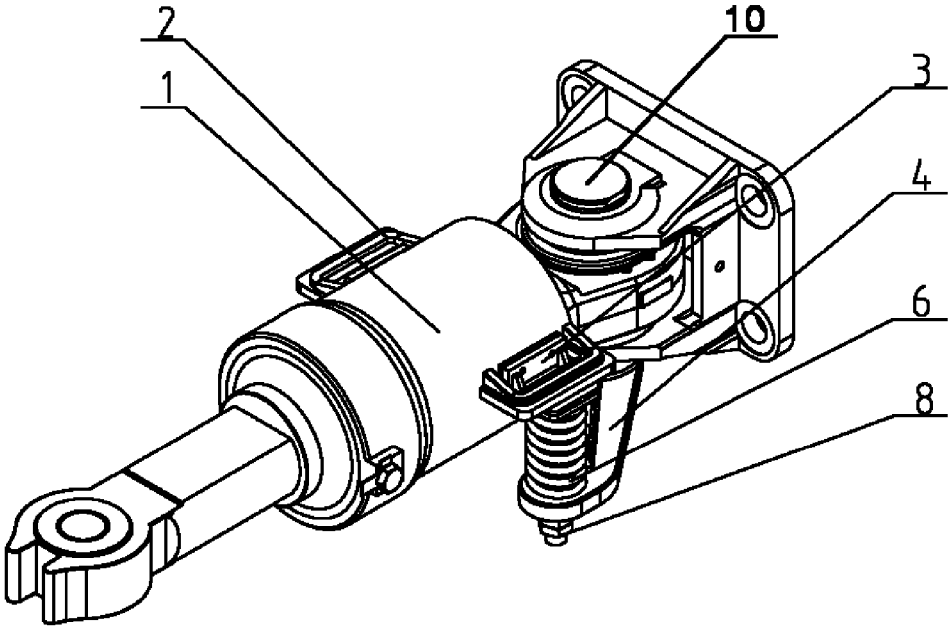
FIG. 2 is an assembled view of the buffer and the vertical spring support device for a coupler.
Figure 3:
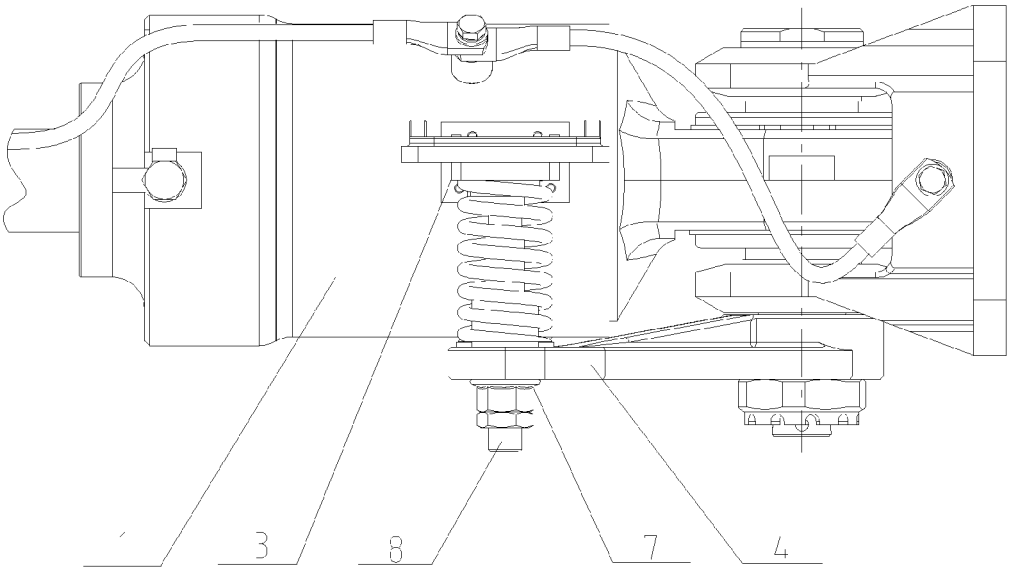
FIG. 3 is a side view of the buffer and the vertical spring support device for a coupler.

As shown in FIG. 1 to FIG. 3, a vertical spring support device for a coupler, is located on two sides of a buffer shell 1 at a rear end of a coupler. Annular wing plates 2, serving as parts for bearing the vertical support force, are provided at opposite positions on two sides of the buffer shell 1. The wing plates 2 are horizontally mounted, and the wing plates 2 are of a half-surrounded structure. A middle portion of each of the wing plates 2 is of a hollow structure for mounting a support platform 3. The support platforms 3 and the coupler buffer shell 1 are clamped by the wing plates 2, so that it is ensured that the vertical support device is always clamped and aligned relative to the coupler buffer shell 1 and does not sway with the coupler during the adjustment of the vertical force.

The vertical spring support device for a coupler is mounted on the wing plates 2 on two sides of the buffer shell 1, and the vertical support device on each side comprises a support platform 3, a bracket 4, a support rod 5, a support spring 6, a wear sleeve 7 and a locknut 8.

An upper end of the support rod 5 is fixedly connected to a lower surface of the support platform 3. A thread structure is provided at a bottom end of the support rod 5. The support spring 6 is mounted between the upper end and a lower end of the support rod 5. The lower end of the support rod 5 passes through the bracket 4 and is then connected to the locknut 8.

Embodiment 2

Based on Embodiment 1, this embodiment further compromises the following technical features.

As shown in FIG. 1, a support platform, a support rod, a support spring, a wear sleeve and a locknut are assembled together in accordance with the relationship described in Embodiment 1 to form an assembled member I. There are two sets of assembled member I in total, which are mounted on two sides of a bracket 4, respectively. The bracket 4 comprises a bracket I 41, a middle bracket 42 and a bracket II 43, and the assembled member I arranged on the bracket I 41 in FIG. 1 is shielded by the buffer shell 1 and thus is not shown in FIG. 1. The bracket 4 is mounted horizontally, and the middle bracket 42 is fixedly connected to the bottom end of a coupler yoke pin 10 to serve to bear the support force. One end of the bracket I 41 and one end of the bracket II 43 are fixedly connected to the middle bracket 42, respectively, and the bracket I 41 and the bracket II 43 are arranged symmetrically. It can be considered that the middle bracket 42 has a bracket central axis 9, and the bracket 4 is symmetrical about the bracket central axis 9. The two sets of assembled member I on the bracket 4 are also symmetrical about the bracket central axis 9. The connection relationship between the bracket 4 and other components will be described below by taking the components on the bracket II 43 as example. The connection relationship between the bracket I 41 and other components is symmetrical to the connection relationship between the bracket II 43 and other components. One end of the bracket II 43 is fixedly connected to the middle bracket 42, while one another end of the bracket II 43 is a cantilevered end at which a bracket guide hole 44 is formed. The support rod 5 passes through the bracket guide hole 44 and is then connected to the locknut 8. A lower end of the support spring 6 is in contact connection to an upper surface of the bracket II 43.

A support platform 3 is in lapped connection to a wing plate 2 for delivering the vertical force. As shown FIG. 1 and FIG. 5 to FIG. 7, the support platform 3 comprises a vertical support platform plate 31 and a horizontal support platform plate 32. A lower surface of the horizontal support platform plate 32 is fixedly connected to an upper end of the support rod 5, the vertical support platform plate 31 is vertically fixed on one side of the horizontal support platform plate 32 close to the buffer shell 1, and reinforcing ribs 33 are provided between the vertical support platform plate 31 and the horizontal support platform plate 32. The vertical support platform plate 31 is embedded into a hollow structure of the annular wing plate 2 from the bottom and then appressed to a surface of the buffer shell 1. A vertical support platform plate moving gap is provided between the vertical support platform plate 31 and the hollow structure of the wing plate 2. To avoid the rigid contact of the vertical support platform plate 31 with the buffer shell 1, a wear plate (not shown in figures) is provided at a contact position between the vertical support platform plate 31 and the buffer shell 1. The horizontal support platform plate 32 is used for bearing the vertical support force of the support spring 6. The lower surface of the horizontal support platform plate 32 is resisted against an upper end of the support spring 6, while an upper surface of the horizontal support platform plate 32 is resisted against a lower surface of the wing plate 2. That is, the horizontal support platform plate 32 is in close contact with and resisted against the upper end of the support spring 6 and the lower surface of the wing plate 2.

An assembly process of the vertical spring support device for a coupler is as follows.

The support spring 6 is sheathed on the support rod 5. The upper end of the support spring 6 is resisted against a lower surface of the support platform 3, while a lower end of the support spring 6 is resisted against an upper end face of the bracket 4. The support rod 5 passes through the bracket II guide hole 44 in the middle of the bracket II 43. The wear sleeve 7 is sheathed on a bottom end of the support rod 5. The locknut 8 is screwed on a thread structure at the bottom end of the support rod 5. That is, the support spring 6 is fixed on the bracket 4 via the support rod 5 and the support platform 3. The middle bracket 42 is sheathed on a bottom end of the coupler yoke pin 10, the vertical support platform plates 31 are inserted into the hollow structure of the wing plates 2 on two sides of the buffer shell 1, respectively, and the bracket 4 is fixed to the bottom end of the coupler yoke pin 10 via a yoke pin nut.

After the vertical spring support device for a coupler is assembled, the amount of compression of the support spring 6 is controlled and adjusted through the locknut 8 and the support rod 5 with the thread structure. That is, the vertical support force of the vertical support device is controlled, and the coupler buffer shell 1 is always maintained in a clamped state while adjusting the vertical support force. Thus, it is ensured that the vertical support device does not sway with the coupler during the adjustment process. Further, the adjustment to the horizontal height of the coupler is accomplished. The specific adjustment process is as follows.

When the coupler is raised, the locknut 8 is screwed upward, so that the amount of compression of the support spring 6 increases, and the length of the support spring 6 becomes shorter. Consequently, the coupler is naturally hung down to the horizontal position.

When the coupler is hung down, the locknut 8 is unscrewed downward, so that the amount of compression of the support spring 6 decreases, and the length of the support length 6 becomes longer. Since the output force of the support spring 6 is always greater than the force required for leveling the coupler, the spring force of the support spring 6 pushes the coupler to the horizontal position.

When the coupler sways, the buffer shell 1 pushes the vertical support platform plate 31 via the wear plate, so that the vertical support device as a whole rotates with the coupler. Since the wing plate 2 on the other side of the buffer shell 1 surrounds the vertical support platform plate 31, the wing plate 2 assists in pushing the vertical support device as a whole to rotate with the coupler. Thus, the dual pushing effect is realized, and it is ensured that the vertical support device synchronously rotates with the coupler.

It is to be noted that, in the specific adjustment process, within the height adjustable range of the support spring 8, the support spring 8 is always in a compressed state; moreover, within the height adjustable range of the support spring 8, it is ensured that the output force of the support spring 8 is always greater than the force required for leveling the coupler, and the adjustment to the height of the coupler is thus realized by adjusting the compressed height of the support spring 8. Meanwhile, the support platforms 3 are distributed on the two sides of the buffer shell 1, respectively, and clamp the buffer shell 1 through the wear plates attached to the vertical support platform plates 31. When the coupler sways, the vertical support device is driven to sway synchronously. Moreover, since the buffer shell surrounds the vertical support platform plates 31 via the wing plates 2, it is ensured that the moving space of the vertical support platform plate 31 is always within the hollow structure of the wing plate 2 without providing a special alignment bracket, and it is further ensured that the vertical support structure sways with the coupler. The support platform 3 and the wing plate 2 are connected in a plug-in manner. That is, the support platform 3 is in contact connection to the wing plate 2. The support platform 3 not only plays a role of bearing the support force, but also always prevents the support spring 6 from inclining during the rotation process of the coupler, so that the vertical support effect of the support spring 6 is ensured.

Embodiment 3

Figure 4:
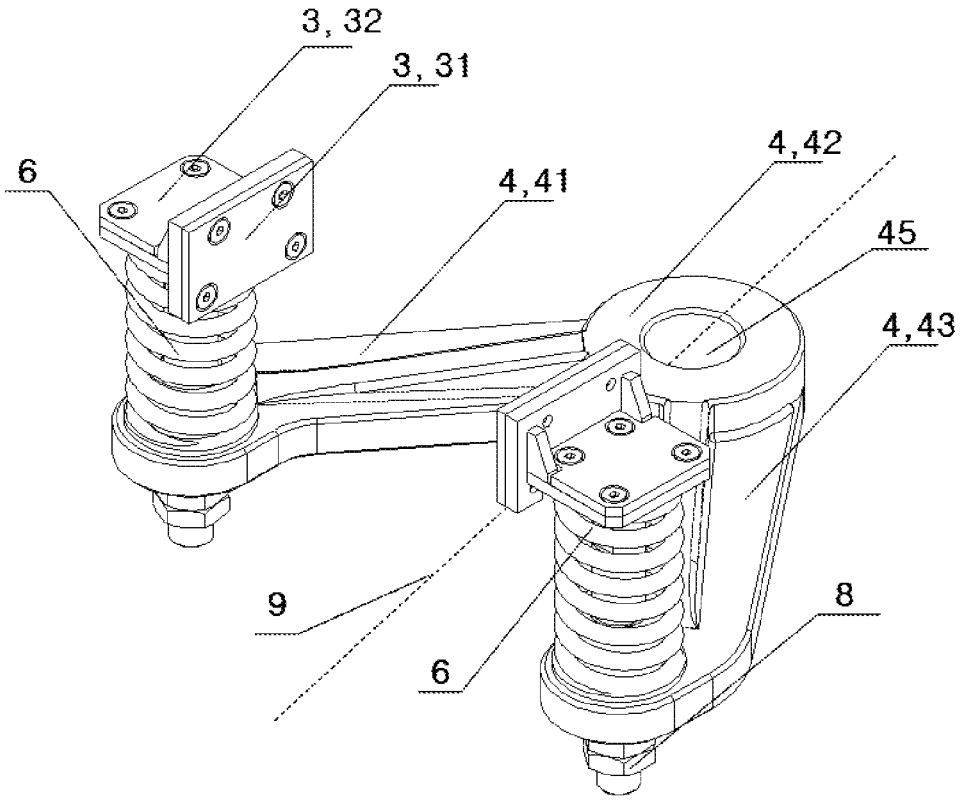
FIG. 4 is a diagram of the vertical spring support device for a coupler alone.
Figure 5:
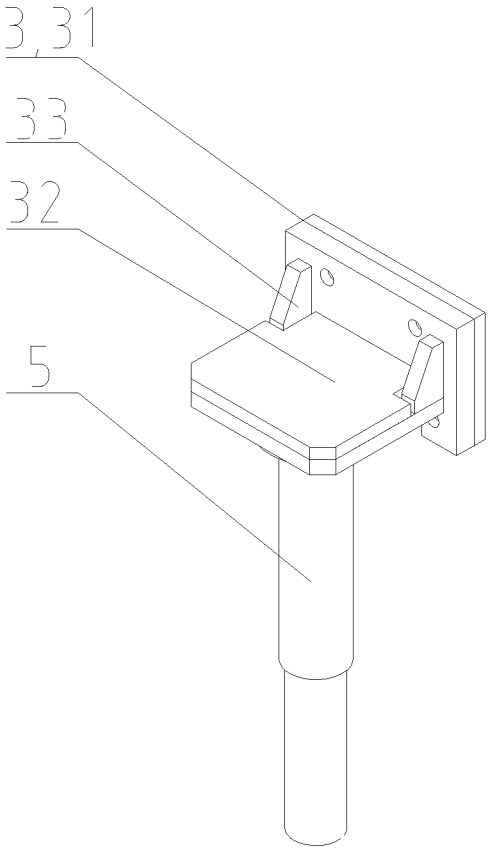
FIG. 5 is a stereoscopic top view of a support platform.
Figure 6:
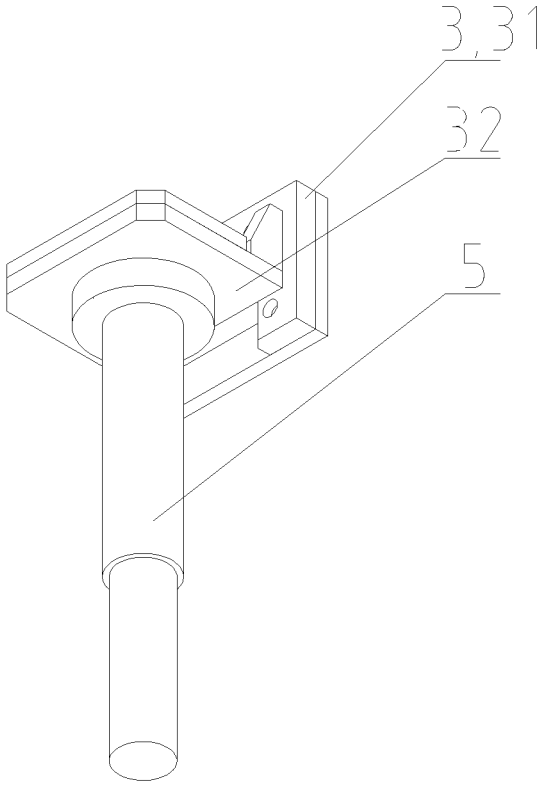
FIG. 6 is a stereoscopic bottom view of the support platform.
Figure 7:
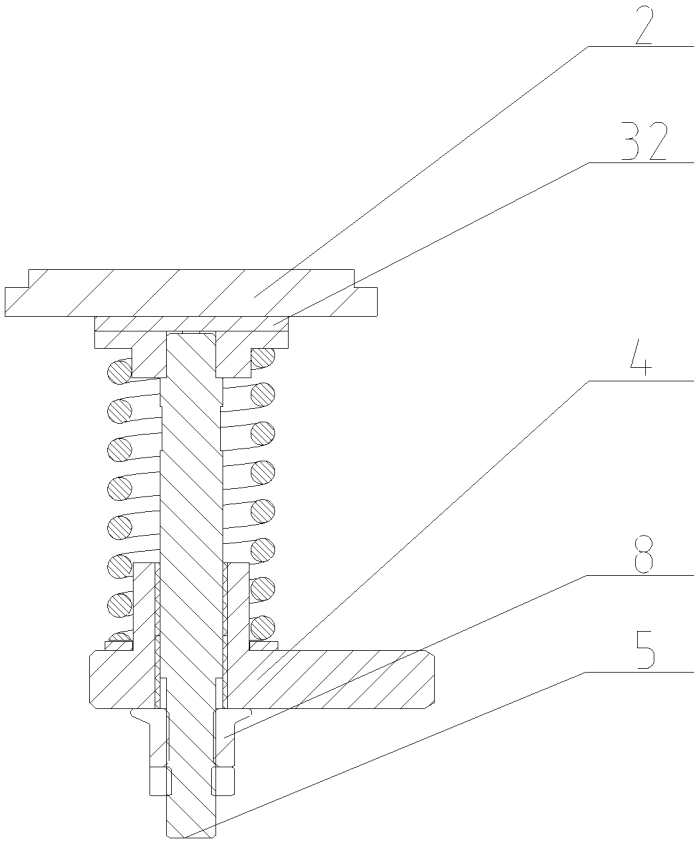

A vertical spring support device for a coupler, as shown in FIG. 1, FIG. 2 and FIG. 4, comprises a support platform 3, a bracket 4, a support rod 5, a support spring 6 and a locknut 8. The support spring 6 is sheathed on the support rod 5. An upper end of the support spring 6 is resisted against a lower surface of the support platform 3, while a lower end of the support spring 6 is resisted against an upper end face of the bracket 4. An upper end of the support rod 5 is fixedly connected to the lower surface of the support platform 3, while a bottom end of the support rod 5 passes through the bracket 4 and is then in threaded connection to the locknut 8. The support platform 3 comprises a vertical support platform plate 31 and a horizontal support platform plate 32. A lower surface of the horizontal support platform plate 32 is fixedly connected to an upper end of the support rod 5. The vertical support platform plate 31 is vertically fixed on one side of the horizontal support platform plate 32. The support platform 3, the support rod 5, the support spring 6 and the locknut 8 are assembled together in accordance with the above connection relationship to form an assembled member II. There are two sets of assembled member II. Two support rods 5 belonging to the two sets of assembled member II separately pass through the bracket 4 and are then separately provided at two ends of the bracket 4. Two vertical support platform plates 31 belonging to the two sets of assembled member II are arranged on inner sides of two horizontal support platform plates 32, respectively.

Embodiment 4

A vertical spring support device for a coupler, as shown in FIG. 1 and FIG. 4, comprises a support platform 3, a bracket 4, a support rod 5, a support spring 6, a wear sleeve 7 and a locknut 8. The support spring 6 is sheathed on the support rod 5. An upper end of the support spring 6 is resisted against a lower surface of the support platform 3, while a lower end of the support spring 6 is resisted against an upper end face of the bracket 4. A bracket guide hole 44 is formed on the bracket 4. An upper end of the support rod 5 is fixedly connected to the lower surface of the support platform 3, while a bottom end of the support rod 5 passes through the bracket guide hole 44 and is then in threaded connection to the locknut 8 via the wear sleeve 7 at a lower end of the support rod 5. The support platform 3 comprises a vertical support platform plate 31 and a horizontal support platform plate 32. A lower surface of the horizontal support platform plate 32 is fixedly connected to an upper end of the support rod 5. The vertical support platform plate 31 is vertically fixed on one side of the horizontal support platform plate 32. The support platform 3, the support rod 5, the support spring 6, the wear sleeve 7 and the locknut 8 are assembled together in accordance with the above relationship to form an assembled member I. There are two sets of assembled member I. Two support rods 5 belonging to the two sets of assembled member I separately pass through the bracket 4 and are then separately provided at two ends of the bracket 4. Two vertical support platform plates 31 belonging to the two sets of assembled member I are arranged on inner sides of two horizontal support platform plates 32, respectively.

The bracket is of a symmetrical structure, and comprises a bracket I 41, a middle bracket 42 and a bracket II 43. It can be considered that a bracket central axis 9 in the middle portion of the middle bracket 42. The bracket I 41 and the bracket II 43 are of a same structure and collectively called sub-brackets, and are symmetrical about the bracket central axis 9. One end of each of the sub-brackets is connected to the middle bracket 42, while an another end of each of the sub-brackets is a cantilevered end at which a bracket guide hole 44 is formed and one set of assembled member I is provided through the bracket guide hole 44. The support rod in one set of assembled member I passes through the bracket guide hole 44 and is then connected to the locknut via the wear sleeve 7 at the lower end of the support rod.

Embodiment 5

A buffer having a vertical spring support device for a coupler, as shown in FIGS. 1 to 7, comprises a buffer shell 1, two support device mounting components, a coupler yoke pin 10, and a vertical spring support device for a coupler.

The two support device mounting components are arranged on two sides of the buffer shell 1, respectively, so that the vertical spring support device for a coupler is mounted on two sides of the buffer shell 1 at the rear end of the coupler. Each of the support device mounting components has a hollow structure.

The vertical spring support device for a coupler is the same as the vertical spring support device described in Embodiment 3 or Embodiment 4.

The vertical support platform plate 31 is embedded into the hollow structure of the respective support device mounting component from the bottom, the vertical support platform plate 31 is appressed to the surface of the buffer shell 1, and a wear plate (not shown in figures) is provided at a contact position between the vertical support platform plate 31 and the buffer shell 11.

Embodiment 6

A buffer having a vertical spring support device for a coupler, as shown in FIGS. 1 to 7, comprises a buffer shell 1, two support device mounting components, a coupler yoke pin 10, and a vertical spring support device for a coupler.

The two support device mounting components are annular wing plates 2 arranged on two sides of the buffer shell 1, respectively, so that the vertical spring support device for a coupler is mounted on two sides of the buffer shell 1 at the rear end of the coupler. The wing plates 2 are horizontally mounted to serve as parts for bearing the vertical support force. Each of the wing plates 2 is of a half-surrounded structure, and a middle portion of each of the wing plates 2 is of a hollow structure for mounting a support platform 3.

The vertical spring support device for a coupler is the same as the vertical spring support device described in Embodiment 3 or Embodiment 4.

The vertical support platform plate 31 is embedded into the hollow structure of the respective support device mounting component from the bottom, the vertical support platform plate 31 is appressed to the surface of the buffer shell 1, and a wear plate (not shown in figures) is provided at a contact position between the vertical support platform plate 31 and the buffer shell 11. The support platform 3 and the coupler buffer shell 1 are clamped by the wing plates 2, so that it is ensured that the vertical support device is always clamped and aligned relative to the coupler buffer shell 1 and does not sway with the coupler during the adjustment of the vertical force.

The foregoing embodiments are merely described as preferred implementations of the present application, and not intended to limit the scope of the present application. Various deformations and improvements made to the technical solutions of the present application by a person of ordinary skill in the art without departing from the design spirit of the present application shall fall into the protection scope defined by the appended claims of the present application.

The invention claimed is:

1. A vertical spring support device for a coupler, wherein, mounting on two sides of a buffer shell at a rear end of a coupler, and support device mounting components are provided at opposite positions on two sides of the buffer shell; the vertical spring support device for a coupler comprises a support platform, a bracket, a support rod, a support spring, a wear sleeve and a locknut; the support spring is sheathed on the support rod, and an upper end of the support spring is resisted against a lower surface of the support platform while a lower end of the support spring is resisted against an upper end face of the bracket; an upper end of the support rod is fixedly connected to the lower surface of the support platform, while a bottom end of the support rod passes through the bracket and is then in threaded connection to the locknut via the wear sleeve; the support platform comprises a vertical support platform plate and a horizontal support platform plate, and a lower surface of the horizontal support platform plate is fixedly connected to the upper end of the support rod; and, the vertical support platform plate is vertically fixed on one side of the horizontal support platform plate close to the buffer shell and embedded into a hollow structure of the support device mounting component from a bottom side, the vertical support platform plate is appressed to a surface of the buffer shell, and a wear plate is provided at a contact position between the vertical support platform plate and the buffer shell.

2. A vertical spring support device for a coupler according to claim 1, wherein, the support device mounting components are annular wing plates which are mounted horizontally and are of a half-surrounded structure; a middle portion of each of the wing plates is of a hollow structure for mounting the support platform; and the support platform and the coupler buffer shell are clamped by the wing plates.

3. A vertical spring support device for a coupler according to claim 2, is characterized by, the lower surface of the horizontal support platform plate is resisted against the upper end of the support spring, while an upper surface of the horizontal support platform plate is resisted against a lower surface of one wing plate.

4. A vertical spring support device for a coupler according to claim 1, wherein, the support platform, the support rod, the support spring, the wear sleeve and the locknut are assembled together in accordance with the above connection relationship to form an assembled member I; there are two sets of assembled member I in total; and, two support rods belonging to the two sets of assembled member I pass through the bracket separately, and the two sets of assembled member I are separately arranged at two ends of the bracket.

5. A vertical spring support device for a coupler according to claim 4, wherein, the bracket comprises a bracket I, a middle bracket and a bracket II; the bracket I and the bracket II are of a same structure and collectively called sub-brackets, and are symmetrical about the middle bracket; one end of each of the sub-brackets is connected to the middle bracket, while one another end of each of the sub-brackets is a cantilevered end at which a bracket guide hole is formed and one set of assembled member I is arranged through the bracket guide hole; the support rod in one set of assembled member I passes through the bracket guide hole and is then connected to the locknut; and, there are two sets of assembled member I, which are symmetrical about the middle bracket.

6. A vertical spring support device for a coupler according to claim 1, wherein, an output force of the support spring is greater than a force required for leveling the coupler.

7. A vertical spring support device for a coupler according to claim 1, wherein, there are two reinforcing ribs in total provided between the vertical support platform plate and the horizontal support platform plate, and the two reinforcing ribs are vertically fixed at two ends of the horizontal support platform plate; each of the reinforcing ribs is of a right trapezoid structure, and a right-angle side of the right trapezoid structure fixed to the vertical support platform plate and a base of the right trapezoid structure fixed to the horizontal support platform plate.

8. A vertical spring support device for a coupler, wherein, comprises a support platform, a bracket, a support rod, a support spring and a locknut; the support spring is sheathed on the support rod, and an upper end of the support spring is resisted against a lower surface of the support platform while a lower end of the support spring is resisted against an upper end face of the bracket; an upper end of the support rod is fixedly connected to the lower surface of the support platform, while a bottom end of the support rod passes through the bracket and is then in threaded connected to the locknut; the support platform comprises a vertical support platform plate and a horizontal support platform plate, a lower surface of the horizontal support platform plate is fixedly connected to the upper end of the support rod, and the vertical support platform plate is vertically fixed on one side of the horizontal support platform plate; the support platform, the support rod, the support spring and the locknut are assembled together in accordance with the above connection relationship to form an assembled member II, and there are two sets of assembled member II; two support rods belonging to the two sets of assembled member II separately pass through the bracket and are separately arranged at two ends of the bracket; and, two vertical support platform plates belonging to the two sets of assembled member II are provided on inner sides of two horizontal support platform plates, respectively.

9. A vertical spring support device for a coupler according to claim 8, wherein, further comprises a wear sleeve, and the bottom end of the support rod passes through the bracket and is then in threaded connection to the locknut via the wear sleeve, and the wear sleeve and the assembled member II are assembled together in accordance with the above relationship to form an assembled member I, and there are two sets of assembled member I.

10. A vertical spring support device for a coupler according to claim 8, wherein, the bracket comprises a bracket I, a middle bracket and a bracket II; the bracket I and the bracket II are of a same structure and collectively called sub-brackets, and are symmetrical about the middle bracket; one end of each of the sub-brackets is connected to the middle bracket, while one another end of each of the sub-brackets is a cantilevered end at which a bracket guide hole is formed and one set of assembled member I or one set of assembled member II is arranged through the bracket guide hole; the support rod in one set of assembled member I or one set of assembled member II passes through the bracket guide hole and is then connected to the locknut; and, there are two sets of assembled member I or assembled member II, which are symmetrical about the middle bracket.

11. A vertical spring support device for a coupler according to claim 10, wherein, a wear plate is provided on an outer side of the vertical support platform plate; and a mounting hole is formed on the middle bracket.

12. A vertical spring support device for a coupler according to claim 9, wherein, the bracket comprises a bracket I, a middle bracket and a bracket II; the bracket I and the bracket II are of a same structure and collectively called sub-brackets, and are symmetrical about the middle bracket; one end of each of the sub-brackets is connected to the middle bracket, while one another end of each of the sub-brackets is a cantilevered end at which a bracket guide hole is formed and one set of assembled member I or one set of assembled member II is arranged through the bracket guide hole; the support rod in one set of assembled member I or one set of assembled member II passes through the bracket guide hole and is then connected to the locknut; and, there are two sets of assembled member I or assembled member II, which are symmetrical about the middle bracket.

13. A vertical spring support device for a coupler according to claim 12, wherein, a wear plate is provided on an outer side of the vertical support platform plate; and a mounting hole is formed on the middle bracket.

* * * * *